US007222935B2

(12) United States Patent
Ono

(10) Patent No.: US 7,222,935 B2
(45) Date of Patent: May 29, 2007

(54) APPARATUS FOR INK-JET RECORDING, AND METHOD FOR CONTROLLING INK-JET RECORDING APPARATUS

(75) Inventor: Ryuta Ono, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 180 days.

(21) Appl. No.: 10/681,252

(22) Filed: Oct. 9, 2003

(65) Prior Publication Data

US 2004/0075712 A1 Apr. 22, 2004

(30) Foreign Application Priority Data

Oct. 11, 2002 (JP) ..... P2002-298440

(51) Int. Cl.
*B41J 2/165* (2006.01)

(52) U.S. Cl. ..... 347/36; 347/85; 347/86; 347/87; 347/88; 347/89

(58) Field of Classification Search ..... 347/36, 347/85–89

See application file for complete search history.

(56) References Cited

U.S. PATENT DOCUMENTS 4,965,596 A * 10/1990 Nagoshi et al. ..... 347/36

FOREIGN PATENT DOCUMENTS

| | | | |
|---|---|---|---|
| JP | 04201353 A | * | 7/1992 |
| JP | 06-210875 | | 8/1994 |
| JP | 11-157098 | | 6/1999 |
| JP | 11-268303 | | 10/1999 |
| JP | 11-334110 | | 12/1999 |
| JP | 2000-141703 | | 5/2000 |

* cited by examiner

*Primary Examiner*—Stephen Meier
*Assistant Examiner*—Ly T. Tran
(74) *Attorney, Agent, or Firm*—The Nath Law Group; Jerald L. Meyer; Matthew J. Moffa

(57) ABSTRACT

An apparatus for ink-jet recording includes: (a) ink tanks installed removably in the apparatus, and configured to store ink; (b) a reservoir tank configured to temporarily store waste ink generated by a printing head for jetting ink supplied from the ink tanks onto the printing paper; (c) waste ink tanks formed in one piece with the ink tanks, and configured to store waste ink; (d) a discharging unit configured to discharge waste ink from the reservoir tank into the waste ink tanks; and (e) a control unit configured to discriminate whether or not the waste ink tanks are empty, and to control the discharging unit to discharge waste ink of a predetermined quantity stored in the reservoir tank into the empty waste ink tank.

22 Claims, 6 Drawing Sheets

APPARATUS FOR INK-JET RECORDING, AND METHOD FOR CONTROLLING INK-JET RECORDING APPARATUS

BACKGROUND OF THE INVENTION

1. Field of the Invention

The present invention pertains to an ink-jet recording apparatus, such as a printer, facsimile, or the like of an ink-jet system, and method for controlling the ink-jet recording apparatus. In particular, the present invention pertains to the management technology for waste ink generated by a printing head.

2. Description of the Related Art

Generally, in an ink-jet recording apparatus, such as an ink-jet printer, waste ink that is not used in printing is generated by a head cleaning operation performed to prevent clogging of an ink-jet printing head or to remove foreign substances adhered around a nozzle of the ink-jet printing head.

Against such a background, the art of installing a waste ink tank for storing the waste ink in an ink-jet printer is disclosed in the Japanese Patent Laid Open Publication (Kokai) No. H11-268303 and No. H11-334110. Further, the art of an ink-jet printer having an absorbent for absorbing waste ink is disclosed in the Japanese Patent Laid Open Publication (Kokai) No. H06-210875. Furthermore, the art of an ink cartridge having the ink tank with the addition of a waste ink absorption function is disclosed in the Japanese Patent Laid Open Publication (Kokai) No. H11-157098 and No. 2000-141703.

However, in the case of the waste ink collection unit, such as the waste ink tank, the waste ink absorbent, or the waste ink absorption function, being installed in the ink-jet printer, besides exchanging the ink tank of the ink for printing, when the waste ink collection unit is full of the waste ink, exchange of the waste ink collection unit must also be performed, and therefore maintenance of the ink-j et printer becomes very cumbersome. Furthermore, if a quantity of waste ink more than or equal to a predetermined quantity is produced, all the waste ink may not be able to be collected in the waste ink collection unit, and therefore waste ink could overflow from the waste ink collection unit.

Moreover, in the case of collecting waste ink to the waste ink tank whenever waste ink occurs, detection of space availability in the waste ink tank and control of the discharge of the waste ink becomes complicated. For example, in the case of an ink cartridge in which each of the colors of Cyan (C), Magenta (M), Yellow (Y), and blacK (K) are united and combined in a single waste ink tank, since what is necessary is just to manage the capacity of the single waste ink tank, the discharge control for preventing the overflow of the waste ink is relatively easy. However, in the case of an ink cartridge having independent ink tanks for each ink color and waste ink tanks provided to each of the ink tanks respectively, since it would be necessary to discriminate between each waste ink tank, managing the available capacity of each waste ink tank, the discharge control of the waste ink becomes complicated.

SUMMARY OF THE INVENTION

An apparatus for ink-jet recording, the apparatus for printing by emitting of a jet of ink onto a printing paper, the apparatus in one embodiment according to the present invention includes: (a) ink tanks installed removably in the apparatus, and configured to store ink; (b) a reservoir tank configured to temporarily store waste ink generated by a printing head for jetting ink supplied from the ink tanks onto the printing paper; (c) waste ink tanks formed in one piece with the ink tanks, and configured to store waste ink discharged from the reservoir tank; (d) a discharging unit configured to discharge waste ink from the reservoir tank into the waste ink tanks; and (e) a control unit configured to discriminate whether or not the waste ink tanks are empty, and to control the discharging unit to discharge waste ink of a predetermined quantity stored in the reservoir tank into the empty waste ink tank.

A method of controlling an apparatus for ink-jet recording, the apparatus including ink tanks removably installed in the apparatus and storing an ink for each color of the ink, a reservoir tank temporarily storing a waste ink generated by a printing head for jetting the ink supplied from the ink tanks onto a printing paper, waste ink tanks formed in one piece with the ink tanks and storing waste ink discharged from the reservoir tank, and a discharging unit discharging waste ink from the reservoir tank into the waste ink tanks, the method in one embodiment according to the present invention includes: (a) storing waste ink generated by the printing head in the reservoir tank; (b) discriminating whether or not the waste ink tank is empty based on information stored in a memory indicating whether or not the waste ink tank is empty; and (c) controlling the discharging unit to discharge waste ink of a predetermined quantity stored in the reservoir tank into the empty waste ink tank discriminated.

DETAILED DESCRIPTION

Figure 1:
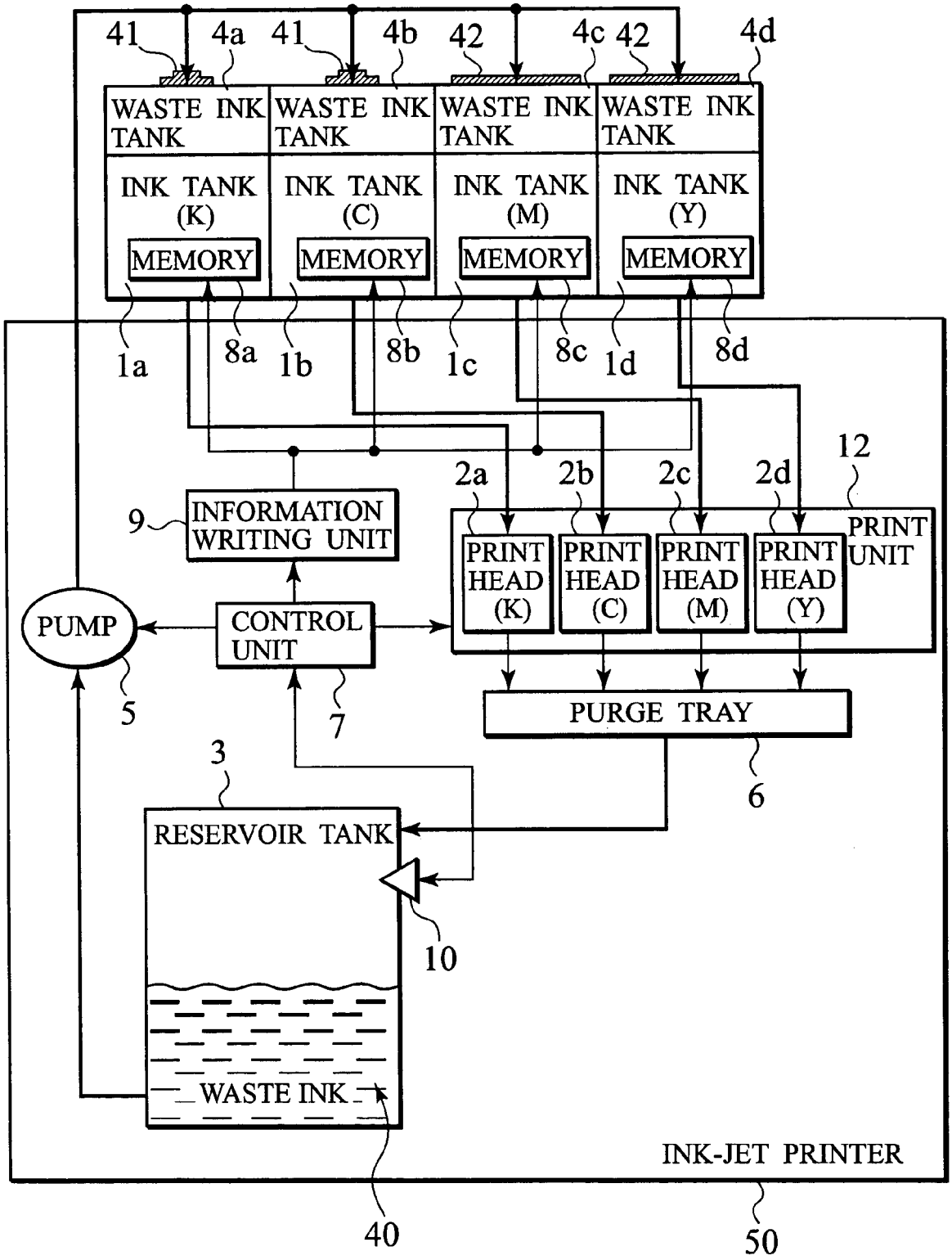
FIG. 1 is a schematic diagram showing an example of a schematic structure of an ink-jet printer according to an embodiment of the present invention.

The present embodiment aims to disclose an ink-jet recording apparatus and a method for controlling ink-jet recording apparatus to make a discharge control of waste ink easy and to make it possible to collect discharged waste ink easily.

An apparatus for ink-jet recording, the apparatus for printing by emitting of a jet of ink onto a printing paper, the apparatus according to the present embodiment includes: (a) ink tanks installed removably in the apparatus, and configured to store ink; (b) a reservoir tank configured to temporarily store waste ink generated by a printing head for jetting ink supplied from the ink tanks onto the printing paper; (c) waste ink tanks formed in one piece with the ink tanks, and configured to store waste ink discharged from the reservoir tank; (d) a discharging unit configured to discharge waste ink from the reservoir tank into the waste ink tanks; and (e) a control unit configured to discriminate whether or not the waste ink tanks are empty, and to control the discharging unit to discharge waste ink of a predetermined quantity stored in the reservoir tank into the empty waste ink tank. In addition, the ink tanks may be installed independently for each color of the ink, and the waste ink tanks may be paired off and formed in one piece with each of the ink tanks respectively.

According to the above composition, since the control unit need only manage the emptiness condition of the waste ink tanks as the two kinds of status of "empty" or "not empty", and need only control the discharging unit to discharge waste ink of the predetermined quantity stored in the reservoir tank to the empty waste ink tank, waste ink can be discharged and collected without performing any complicated control. Further, since the waste ink can be distributed and discharged into the waste ink tank for every ink color, the capacity of the waste ink tanks can also be configured small. Furthermore, when exchanging the ink tank of each color, the waste ink tank can also be discarded together.

In addition, the predetermined quantity of waste ink discharged from the reservoir tank may be defined as smaller than or equal to the quantity of the capacity of one of the waste ink tanks.

Each of the ink tanks have memories to store information indicating whether or not each of the waste ink tanks is empty respectively, and the control unit discriminates as to whether or not each of the waste ink tanks are empty based on the information stored in each of the memories. Moreover, the control unit writes the information indicating that the waste ink tank is full into the memory of the waste ink tank to which the waste ink is discharged.

Further, the control unit can control the discharging unit to discharge the waste ink into the waste ink tank formed in one piece with the ink tank with the highest supply frequency of the ink, when there are two or more empty waste ink tanks. According to such composition, even if variations in the amount of the ink consumption occur for every ink color, the waste ink can be distributed and discharged into the waste ink tank optimally.

Furthermore, the apparatus includes a waste ink sensor configured to detect the quantity of waste ink stored in the reservoir tank, and when the control unit detects that the quantity of waste ink stored in the reservoir tank exceeds a predetermined quantity based on a detection result of the waste ink sensor, the control unit may control the discharging unit to discharge waste ink of the predetermined quantity stored in the reservoir tank into the empty waste ink tank.

Moreover, the control unit discriminates whether or not the waste ink tank formed in one piece with the ink tank which has consumed ink of the predetermined quantity is empty, and may control the discharging unit to discharge waste ink of the predetermined quantity stored in the reservoir tank into the waste ink tank discriminated as being empty, when the quantity of waste ink detected by the waste ink sensor is more than or equal to the predetermined quantity. In addition, the control unit may also control the discharging unit to discharge all of the waste ink stored in the reservoir tank into the corresponding empty waste ink tank, when the quantity of waste ink detected by the waste ink sensor is less than the predetermined quantity.

Further, the discharging unit may be composed of a pump, and the control unit can control the quantity of the waste ink to be discharged based on a driving duration of the pump.

Furthermore, a pouring mouth of the waste ink tanks may be configured as a sealing structure. According to such composition, leaking of the waste ink from the waste ink tanks can be prevented.

Moreover, a tank only for waste ink, which is entirely formed for storing waste ink, may be installed instead of the ink tank formed in one piece with the waste ink tank, and thus the control unit may control the discharging unit to force the discharge of the waste ink into the tank only for waste ink. According to such composition, it can be coped with when the waste ink in the reservoir tank exceeds the predetermined quantity sharply.

In addition, the control unit may control the discharging unit to discharge waste ink of the predetermined quantity from the reservoir tank into the waste ink tank in multiple steps. The control unit also may control the discharging unit to discharge the predetermined quantity in a single step.

Further, a method of controlling an apparatus for ink-jet recording, the apparatus including ink tanks removably installed in the apparatus and storing an ink for each color of the ink, a reservoir tank temporarily storing a waste ink generated by a printing head for jetting the ink supplied from the ink tanks onto a printing paper, waste ink tanks formed in one piece with the ink tanks and storing waste ink discharged from the reservoir tank, and a discharging unit discharging waste ink from the reservoir tank into the waste ink tanks, the method according to the present embodiment includes: (a) storing waste ink generated by the printing head in the reservoir tank; (b) discriminating whether or not the waste ink tank is empty based on information stored in a memory indicating whether or not the waste ink tank is empty; and (c) controlling the discharging unit to discharge waste ink of a predetermined quantity stored in the reservoir tank into the empty waste ink tank discriminated.

In addition, when a fresh ink tank is installed in the apparatus, the waste ink tank formed in one piece with the fresh ink tank is discriminated as being empty, and the discharging unit is controlled to discharge the waste ink of the predetermined quantity stored in the reservoir tank into the waste ink tank discriminated as empty.

Further, the apparatus may include a waste ink sensor configured to detect the quantity of waste ink stored in the reservoir tank. When the waste ink sensor detects that the quantity of waste ink stored in the reservoir tank exceeds the predetermined quantity, the waste ink tank is discriminated as being empty, and the discharging unit is controlled to discharge the waste ink of the predetermined quantity stored in the reservoir tank into the waste ink tank discriminated as empty.

Furthermore, the waste ink tank formed in one piece with the ink tank which has consumed ink of the predetermined quantity is discriminated as being empty, the discharging unit is controlled to discharge waste ink of the predetermined quantity stored in the reservoir tank into the waste ink tank discriminated as being empty, when the quantity of the waste ink detected by the waste ink sensor is more than or equal to the predetermined quantity. On the other hand, the discharging unit is controlled to discharge all of the waste ink stored in the reservoir tank into the corresponding empty waste ink tank, when the quantity of waste ink detected by the waste ink sensor is less than the predetermined quantity.

Various embodiments of the present invention will be described herein below with reference to the accompanying FIGS. 1 through 6. It is to be noted that the same or similar reference numerals are applied to the same or similar parts and elements throughout the drawings, and the description of the same or similar parts and elements will be omitted or simplified.

[Components of Ink-jet Printer]

As shown in FIG. 1, an ink-jet printer 50 according to the present embodiment includes ink tanks 1*a*, 1*b*, 1*c*, and 1*d*, print unit 12 having print heads 2*a*, 2*b*, 2*c*, and 2*d*, a purge tray 6, a reservoir tank 3, waste ink tanks 4*a*, 4*b*, 4*c*, and 4*d*, a pump 5 and a control unit 7.

The ink tanks 1*a*, 1*b*, 1*c*, and 1*d* are installed in the ink-jet printer 50 independently and removably, and store non-volatile ink for printing of each color of CMYK. The print heads 2*a*, 2*b*, 2*c*, and 2*d* print by emitting a jet of the ink of each color of CMYK supplied from the ink tanks 1*a*, 1*b*, 1*c*, and 1*d* onto printing paper (not shown). The reservoir tank 3 holds temporarily waste ink discharged on the purge tray 6 during the process of the cleaning operation carried out to the printing heads 2*a*, 2*b*, 2*c*, and 2*d*.

The pump 5 is a discharging unit for sending waste ink stored in the reservoir tank 3 into the waste ink tanks 4*a*, 4*b*, 4*c*, and 4*d*. In addition, the discharging unit may consist of valves or the like apart from the pump 5 as shown in FIG. 1. Especially, when the reservoir tank 3 is arranged at a position upward of the position of the waste ink tanks 4*a*, 4*b*, 4*c*, and 4*d*, a valve cheaper than the pump 5 may be used as the discharging unit.

Each of the waste ink tanks 4*a*, 4*b*, 4*c*, and 4*d* is paired off and is formed in one piece with each of the ink tanks 1*a*, 1*b*, 1*c*, and 1*d* respectively, and stores waste ink. Each of the ink tanks 1*a*, 1*b*, 1*c*, and 1*d* which become empty of ink as it is consumed are individually exchanged for a fresh ink tank with the waste ink tanks 4*a*, 4*b*, 4*c*, and 4*d* in which waste ink is stored, respectively. In addition, a pouring mouth of the waste ink tanks 4*a*, 4*b*, 4*c*, and 4*d* may be configured as a sealing structure such as a valve 41, a seal 42 or the like as shown in FIG. 1. According to such composition, leaking of the waste ink from the waste ink tanks 4*a*, 4*b*, 4*c*, and 4*d* can be prevented. Further, a bottle type container or a container like an aluminum pack may be used for the waste ink tanks 4*a*, 4*b*, 4*c*, and 4*d*.

The control unit 7 controls processing operations of the pump 5, the print heads 2*a*, 2*b*, 2*c*, and 2*d*, and the information writing unit 9, discriminates whether or not the waste ink tanks 4*a*, 4*b*, 4*c*, and 4*d* are empty, and controls a pump 5 to discharge waste ink of a predetermined quantity S stored in the reservoir tank 3 into the empty waste ink tank 4*a*, 4*b*, 4*c*, 4*d*. The predetermined quantity S of waste ink discharged from the reservoir tank 3 is defined as smaller than or equal to the quantity of the capacity of one of the waste ink tanks 4*a*, 4*b*, 4*c*, and 4*d*. The control unit 7 controls the quantity of waste ink discharged from the reservoir tank 3 into the waste ink tanks 4*a*, 4*b*, 4*c*, 4*d*, based on a driving duration or a driving frequency of the pump 5.

The control unit 7 may control the pump 5 to discharge waste ink of the predetermined quantity S from the reservoir tank 3 into the waste ink tank 4*a*, 4*b*, 4*c*, or 4*d* in multiple steps. The control unit 7 also may control the pump 5 to discharge the predetermined quantity S in a single step.

Each of the ink tanks 1*a*, 1*b*, 1*c*, and 1*d* have memories 8*a*, 8*b*, 8*c*, and 8*d* to store information indicating whether or not each of the waste ink tanks 4*a*, 4*b*, 4*c*, and 4*d* formed in one piece with each of the ink tanks 1*a*, 1*b*, 1*c*, and 1*d* is empty respectively, and the information is written in each of the memories 8*a*, 8*b*, 8*c*, and 8*d* respectively by controlling the information writing unit 9 using the control unit 7. The control unit 7 discriminates as to whether or not each of the waste ink tanks 4*a*, 4*b*, 4*c*, and 4*d* are empty based on the information stored in each of the memories 8*a*, 8*b*, 8*c*, and 8*d*. Moreover, the control unit 7 controls the information writing unit 9 to write the information indicating that the waste ink tank is full into the memory 8*a*, 8*b*, 8*c*, or 8*d* of the waste ink tank 4*a*, 4*b*, 4*c*, or 4*d* to which the waste ink is discharged. In addition, in the case where the control unit 7 discriminates "whether or not the waste ink tank 4*a*, 4*b*, 4*c*, or 4*d* is empty", the control unit 7 may discriminate not only by determining using "the information indicating whether or not the waste ink tank is empty" stored in memories 8*a*, 8*b*, 8*c*, and 8*d* but also by the presence or absence of "information indicating that the waste ink tank is filled to capacity".

Moreover, the control unit 7 controls the pump 5 to discharge the waste ink into the waste ink tank 4*a*, 4*b*, 4*c*, or 4*d* formed in one piece with the ink tank 1*a*, 1*b*, 1*c*, or 1*d* with the highest supply frequency of the ink, when there are two or more empty waste ink tanks 4*a*, 4*b*, 4*c*, or 4*d*. In addition, when there are two or more empty waste ink tanks 4*a*, 4*b*, 4*c*, or 4*d*, apart from selecting the target for discharge of the waste based on "the supply frequency of ink", the waste ink tank 4*a*, 4*b*, 4*c*, or 4*d* formed in one piece with the ink tank 1*a*, 1*b*, 1*c*, or 1*d* with the longest "installation duration" or the highest "ink supply quantity" may be selected as the target for discharge of the waste ink. Besides, the control unit 7 also may select the target for discharge of the waste ink by combining condition items, such as "the supply frequency of ink", "installation duration", and "ink supply quantity".

Figure 5:
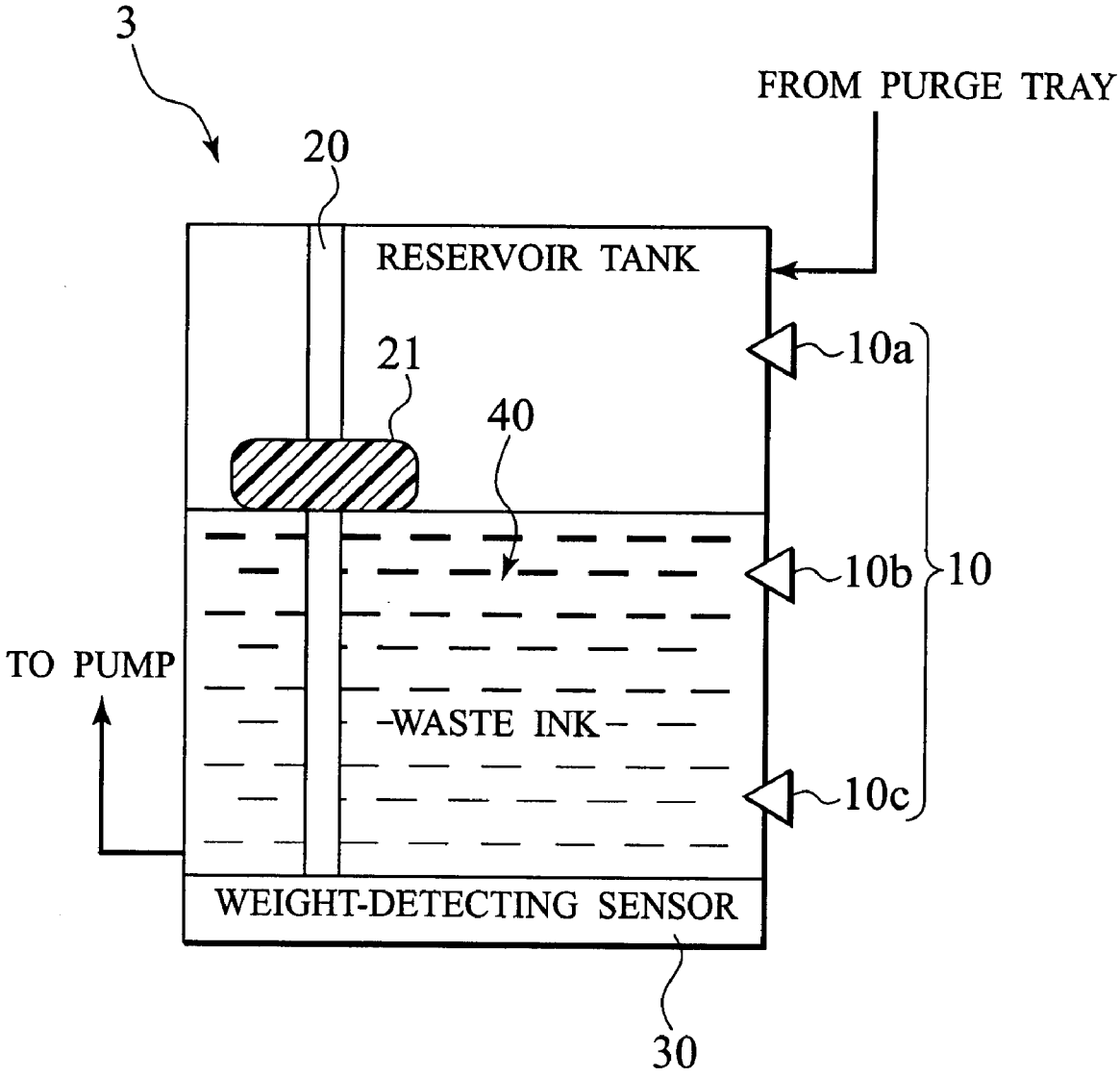
FIG. 5 is a schematic diagram showing an example of a schematic structure of a waste ink sensor installed in a reservoir tank in the ink-jet printer apparatus shown in FIG. 1.

The reservoir tank 3 is equipped with a waste ink sensor 10 for detecting the quantity of waste ink currently held, and the detected signal by the waste ink sensor 10 is outputted to the control unit 7. The waste ink sensor 10 is constituted by any one or any combination of a weight-detecting sensor 30, an optical sensor 10 (or an electrostatic capacitance sensor) of a multi-stage type, a float sensor 20 or the like as shown in FIG. 5.

For example, in the case of the weight-detecting sensor 30, when the quantity of waste ink stored in the reservoir tank 3 changes, a distortion gauge of the weight-detecting sensor 30 inside will be displaced, and the output voltage value from the weight-detecting sensor 30 will change. Therefore, when the weight-detecting sensor 30 is used, by managing the quantity of waste ink stored in the reservoir tank 3 based on the voltage value outputted from the weight-detecting sensor 30 and starting the waste ink discharge operation when the voltage value becomes a predetermined voltage value, it becomes possible to discharge waste ink of the predetermined quantity S from the reservoir tank 3 into the waste ink tank 4*a*, 4*b*, 4*c*, 4*d*.

The control unit 7 controls the pump 5 to discharge the waste ink of the predetermined quantity S, at the time of detecting that the quantity of waste ink held by the reservoir tank 3 exceeds the predetermined quantity, based on the detection result of the waste ink sensor 10, 20, and/or 30.

[Processing Operation of Ink-jet Printer]

The ink-jet printer 50 having the above composition can manage waste ink simply by controlling waste ink to send it into the waste ink tank 4*a*, 4*b*, 4*c*, 4*d* from the reservoir tank 3, as shown below.

Figure 2:
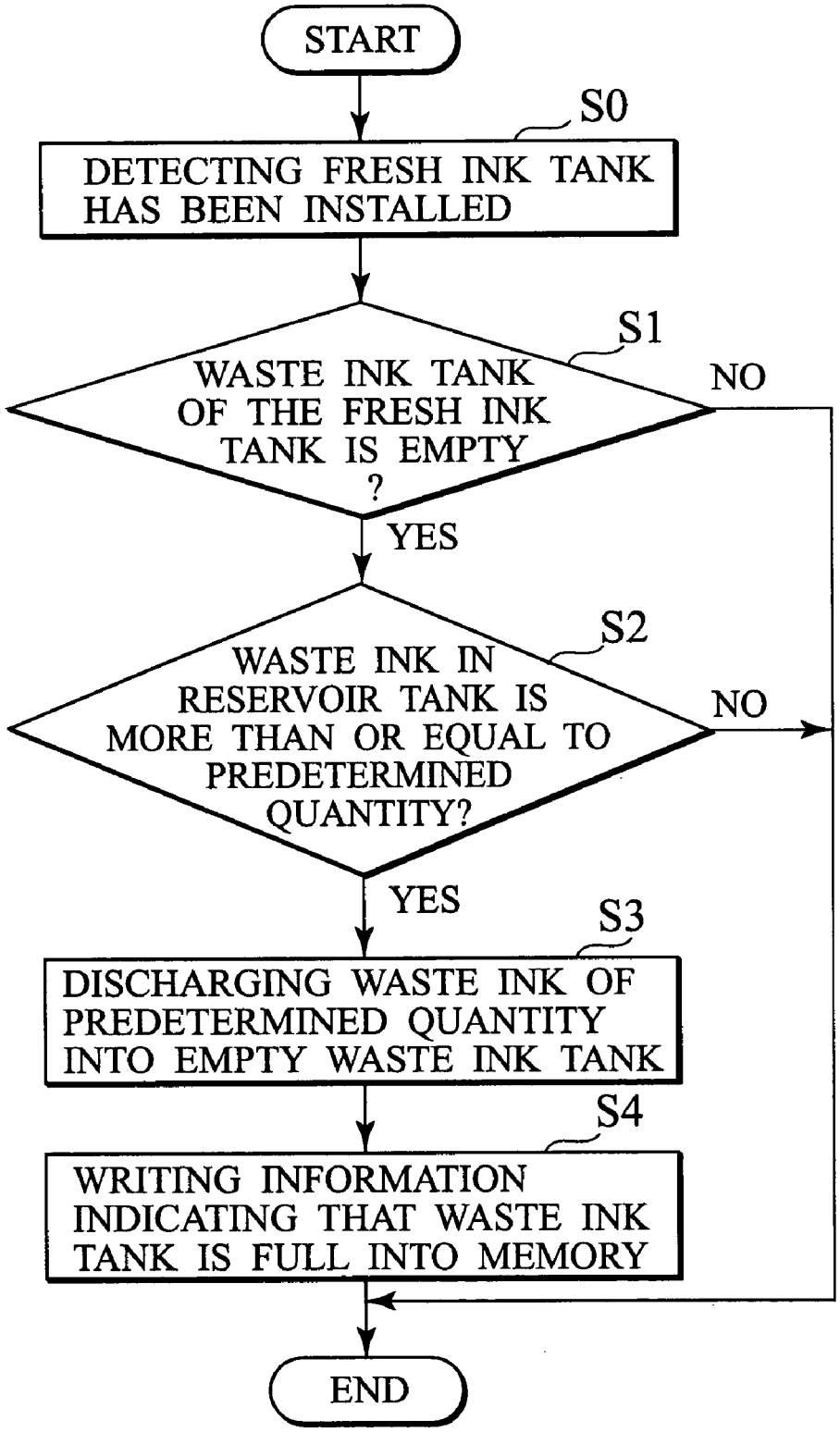
FIG. 2 is a flow chart showing the example of control processing procedure of the ink-jet printer according to a first embodiment.
Figure 3:
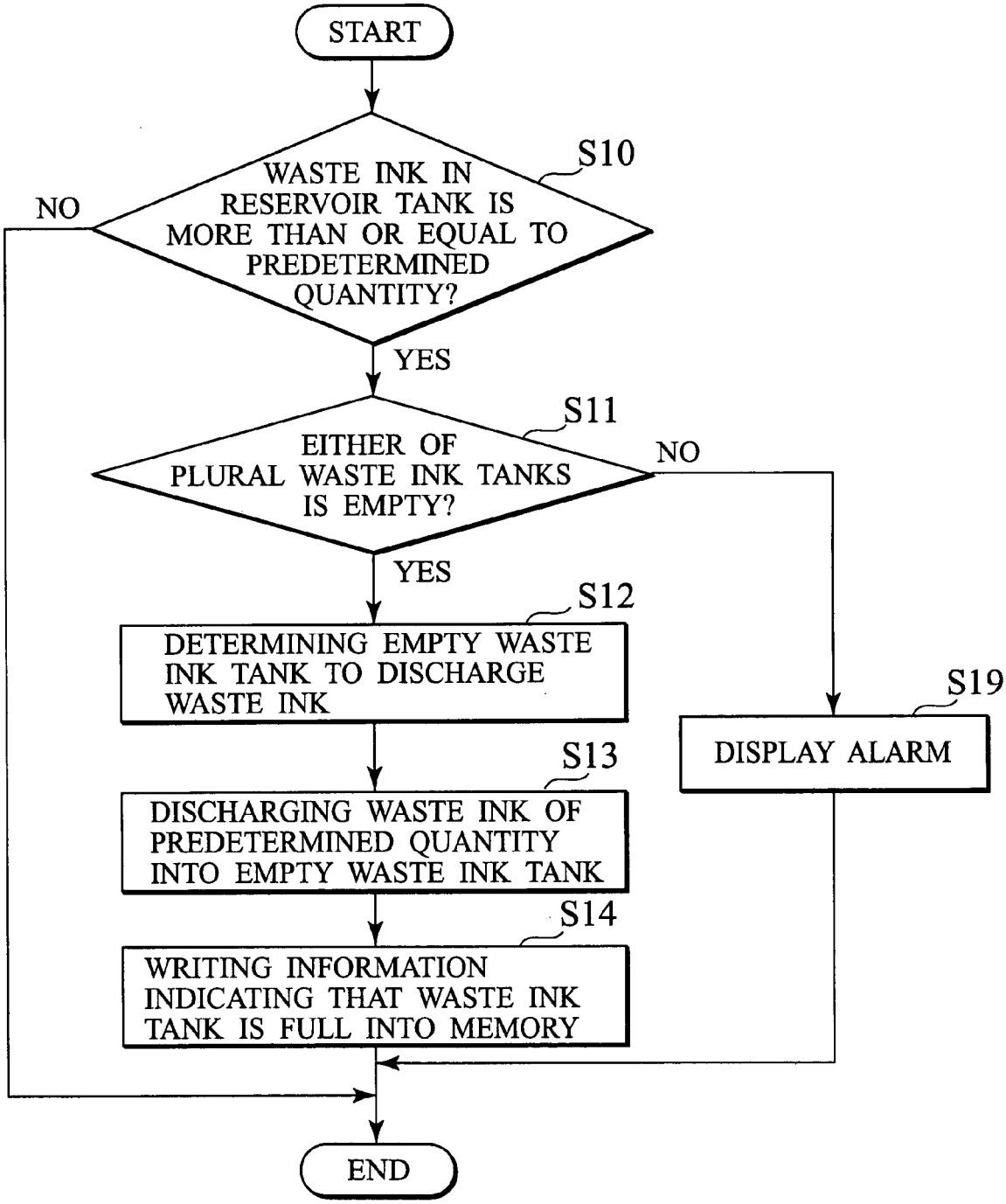
FIG. 3 is a flow chart showing the example of control processing procedure of the ink-jet printer according to a second embodiment.
Figure 4:
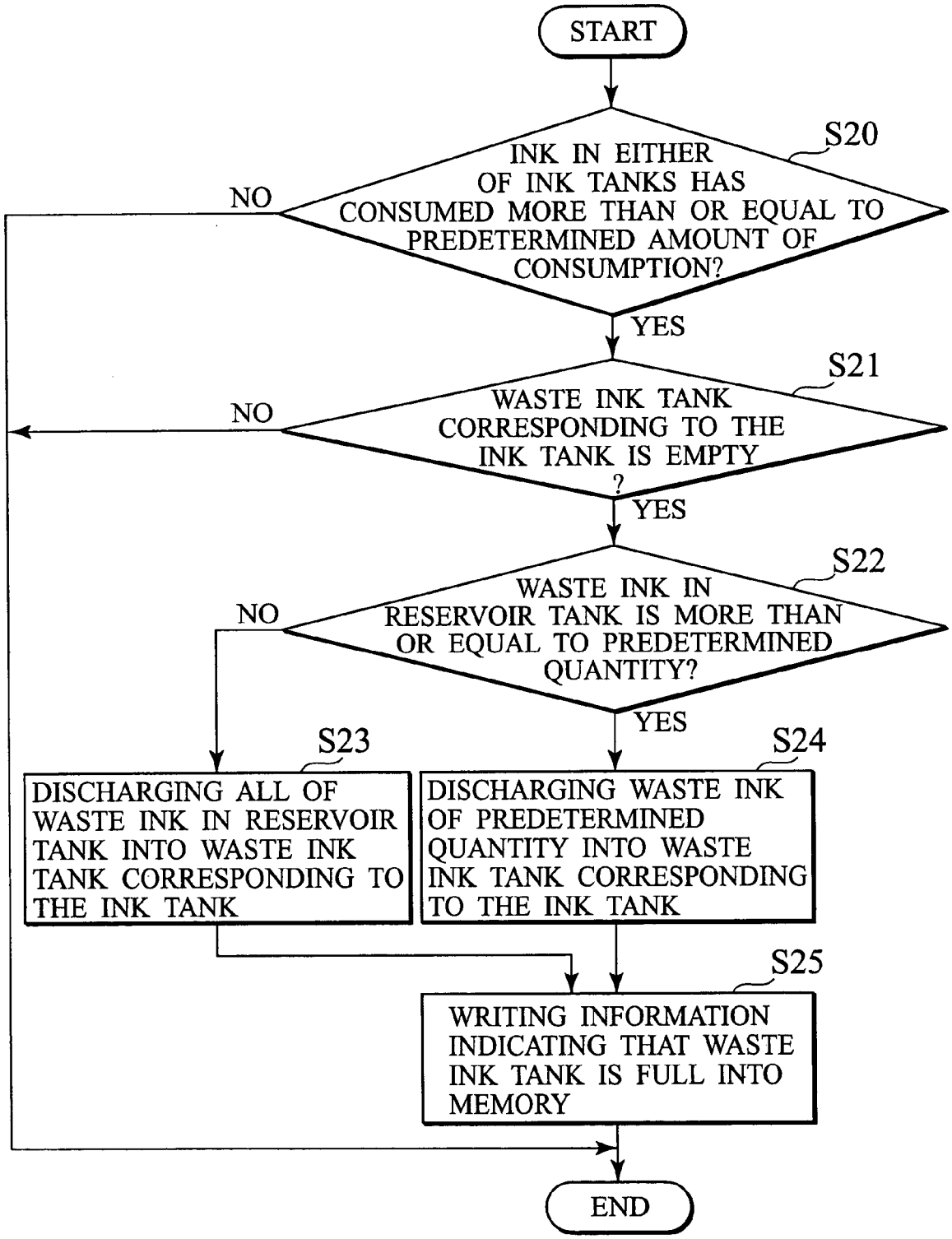
FIG. 4 is a flow chart showing the example of control processing procedure of the ink-jet printer according to a third embodiment.

Hereafter, control processing of the ink-jet printer 50 according to the first to third embodiments will be described herein below with reference to the accompanying flowcharts as shown in FIGS. 2 through 4. In addition, in the examples explained below, the capacity of the reservoir tank 3 is assumed to be 150 [$cm^3$], the capacity of each the waste ink tank 4*a*, 4*b*, 4*c*, and 4*d* is assumed to be 100 [$cm^3$] respectively, and the predetermined quantity S of waste ink to be discharged from the reservoir tank 3 into the waste ink tank 4*a*, 4*b*, 4*c*, 4*d* is assumed to be 100 [$cm^3$].

[First Embodiment]

In the first embodiment, when a fresh ink tank (for example, ink tank 1*d*) is installed in the ink-jet printer 50, the control unit 7 discriminates whether or not the waste ink tank 4*d* formed in one piece with the installed fresh ink tank 1*d* is empty, and controls the pump to discharge waste ink of the predetermined quantity S (100 $cm^3$) stored in the reservoir tank 3 into the discriminated empty waste ink tank 4*d*.

As shown in the flowchart of FIG. 2, in Step S0, when a user installs a fresh ink tank (for example, ink tank 1*d*) in the ink-jet printer 50 for a purpose such as ink exchange, the control unit 7 detects that the ink tank 1*d* has been installed.

In Step S1, the control unit 7 discriminates whether or not the waste ink tank 4*d* formed in one piece with the ink tank 1*d* is empty, based on information written to the memory 8*d* of the ink tank 1*d*. As a result of the discrimination, if the waste ink tank 4*d* is not empty, the control unit 7 ends the series of processings. On the other hand, as a result of the discrimination, if the waste ink tank 4*d* is empty, the processing goes to Step S2.

In Step S2, the control unit 7 discriminates whether or not the quantity of waste ink stored in the reservoir tank 3 is more than or equal to 100 $cm^3$, based on a detected signal from the waste ink sensor 10. As a result of the discrimination, if the quantity of waste ink stored in the reservoir tank 3 is less than 100 $cm^3$, the control unit 7 determines that it is not necessary to discharge the waste ink and ends the series of processings. On the other hand, if, as a result of the discrimination, the quantity of the waste ink stored in the reservoir tank 3 is more than or equal to 100 $cm^3$, the processing goes to Step S3.

In Step S3, the control unit 7 controls the pump 5 to discharge waste ink of the predetermined quantity S (100 $cm^3$) into the waste ink tank 4*d* formed in one piece with the ink tank 1*d*, referring to the driving frequency of the pump 5 and/or the detected signal from the waste ink sensor 10.

Next, in Step S4, the control unit 7 controls the information writing unit 9 to write the information indicating that the waste ink tank 4*d* is full (full waste ink tank information) to the memory 8*d* of the ink tank 1*d*.

Thus, since the control unit 7 need only manage the empty capacity condition of each of the waste ink tanks 4*a*, 4*b*, 4*c*, and 4*d* as two kinds of status of "empty" or "not empty", and need only control the pump 5 to discharge waste ink of the predetermined quantity S (100 $cm^3$) stored in the reservoir tank 3 into the empty waste ink tank 4*a*, 4*b*, 4*c*, or 4*d*, waste ink can be discharged and collected without any performing complicated control.

[Second Embodiment]

In the second embodiment, when the control unit 7 detects that the quantity of waste ink stored in the reservoir tank 3 is more than or equal to the predetermined quantity S (100 $cm^3$), the control unit 7 discriminates whether or not there is an empty waste ink tank 4*a*, 4*b*, 4*c*, or 4*d*, and controls the pump 5 to discharge the waste ink of the predetermined quantity S (100 $cm^3$) stored in the reservoir tank 3 into the waste ink tank 4*a*, 4*b*, 4*c*, or 4*d* determined as being empty.

As shown in the flowchart of FIG. 3, in Step S10, the control unit 7 discriminates whether or not the quantity of waste ink stored in the reservoir tank 3 is more than or equal to the predetermined quantity S (100 $cm^3$), based on the detection result of the waste ink sensor 10, 20, and/or 30. As a result of the discrimination, if the quantity of waste ink stored in the reservoir tank 3 is less than the predetermined quantity S (100 $cm^3$), the control unit 7 determines that it is not necessary to discharge the waste ink and ends the series of processings. On the other hand, if, as a result of the discrimination, the quantity of the waste ink stored in the reservoir tank 3 is more than or equal to the predetermined quantity S (100 $cm^3$), the processing goes to Step S11.

In Step S11, the control unit 7 discriminates whether or not there is an empty waste ink tank among the waste ink tanks 4*a*, 4*b*, 4*c*, and 4*d*, based on information stored in the memories 8*a*, 8*b*, 8*c*, and 8*d* of the ink tanks 1*a*, 1*b*, 1*c*, and 1*d*. As a result of the discrimination, if there is no empty waste ink tank among the waste ink tanks 4*a*, 4*b*, 4*c*, and 4*d*, the control unit 7 outputs an alarm of "No empty waste ink tank" and ends the series of processings.

Figure 6:
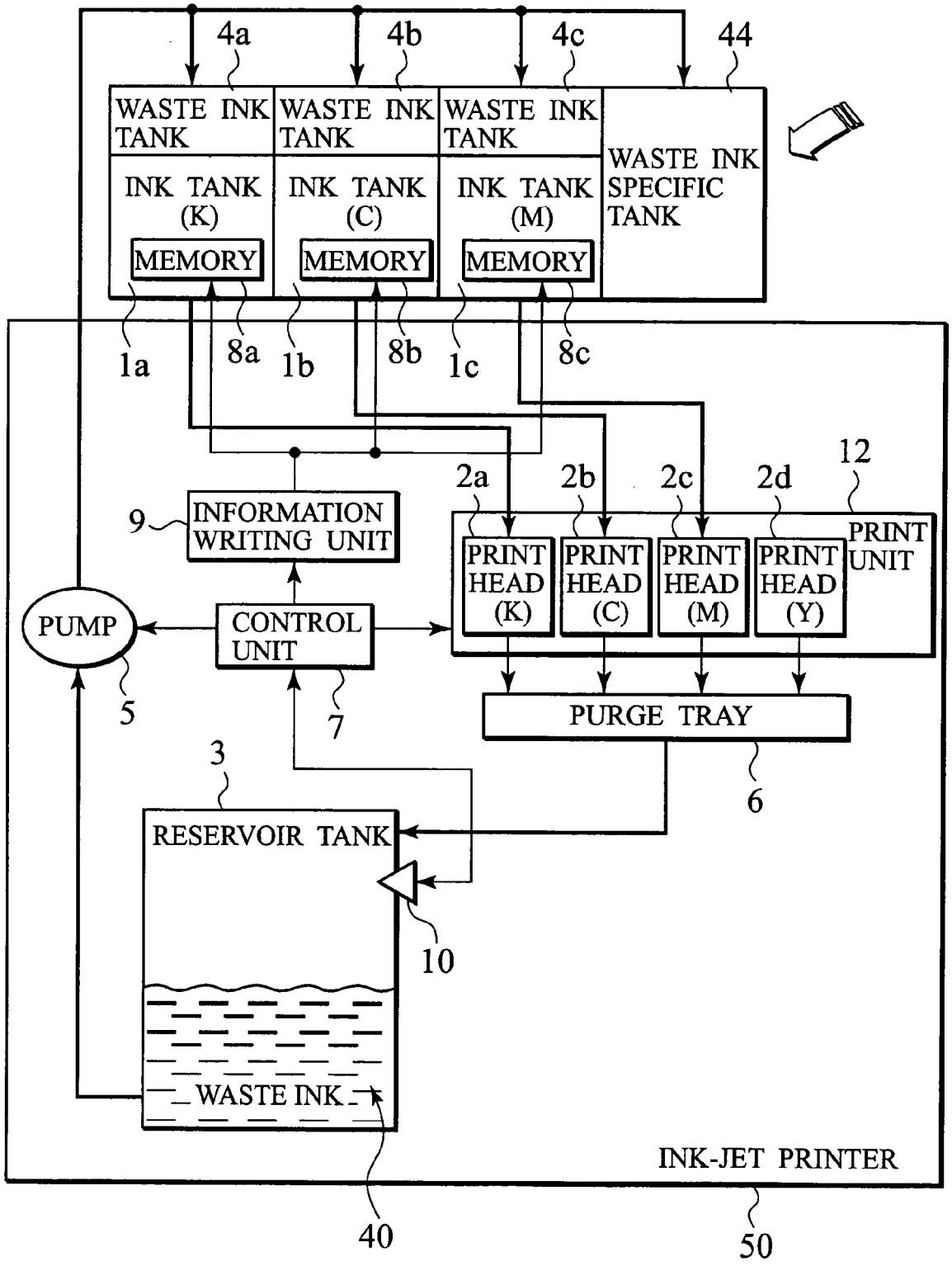
FIG. 6 is a schematic diagram showing an example of an ink-jet printer equipped with a tank only for waste ink (waste ink specific tank) instead of the monochromatic ink tank in the ink-jet printer shown in FIG. 1.

When there is no empty waste ink tank as the target for discharge of the waste ink, as shown in FIG. 6, for example, a tank 44 only for waste ink, which is entirely formed for storing waste ink, may be installed instead of the ink tank 1*d* formed in one piece with the waste ink tank 4*d*, and thus the control unit 7 may control the pump 5 to force the discharge of the waste ink into the tank 44. Moreover, all the waste ink stored in the reservoir tank 3 can be removed using the tank 44 only for the waste ink, and thus the repair or maintenance of the ink-jet printer 50 can also be performed.

Returning to the flow chart of FIG. 3, as a result of the discrimination in Step S11, if there is empty waste ink tank among the waste ink tanks 4*a*, 4*b*, 4*c*, and 4*d*, the processing goes to Step S12.

In Step S12, the control unit 7 determines the waste ink tank for discharge of the waste ink from the reservoir tank 3 from among the empty waste ink tanks 4*a*, 4*b*, 4*c*, or 4*d*. At this point, when there are two or more empty waste ink tanks 4*a*, 4*b*, 4*c*, or 4*d*, the control unit 7, for example, determines the waste ink tank formed in one piece with the ink tank 1*a*, 1*b*, 1*c*, or 1*d* with the highest supply frequency of ink, as the target for discharge of the waste ink. Thus, by determining the target for discharge of the waste ink, the waste ink can be discharged with priority given to the waste ink tank molded with the ink tank with the highest exchange frequency. Here, if the ink tank 1*a* is assumed as being the ink tank with the highest supply frequency of the ink, then the waste ink tank 4*a* is assumed to be determined as the target for discharge of the waste ink by the control unit 7.

Next, in Step S13, the control unit 7 controls the pump 5 to discharge waste ink of the predetermined quantity S (100 $cm^3$) to the waste ink tank 4*a* determined in Step S12, referring to the driving frequency of the pump 5 and/or the detected signal from the waste ink sensor 10.

Next, in Step S14, the control unit 7 controls the information writing unit 9 to write information indicating that the waste ink tank 4*d* is full to the memory 8*a* of the ink tank 1*a*.

[Third Embodiment]

In the third embodiment, when the ink of either of the ink tanks 1*a*, 1*b*, 1*c*, and 1*d* has been consumed to a predetermined quantity of consumption, the control unit 7 discriminates whether or not the waste ink tank 4*a*, 4*b*, 4*c*, or 4*d* corresponding to the ink tank which has been consumed to the predetermined quantity is empty. As a result of the discrimination, if the corresponding waste ink tank is empty, when the quantity of waste ink stored in the reservoir tank 3 is more than or equal to the predetermined quantity S (100 $cm^3$), the control unit 7 controls the pump 5 to discharge the waste ink of the predetermined quantity S (100 $cm^3$) stored in the reservoir tank 3 into the corresponding empty waste ink tank. If the corresponding waste ink tank is empty, when the quantity of the waste ink stored in the reservoir tank 3 is less than the predetermined quantity S (100 $cm^3$), the control unit 7 controls the pump 5 to discharge all of the waste ink stored in the reservoir tank 3 into the corresponding empty waste ink tank. That is, when the waste ink tank 4*a*, 4*b*, 4*c*, or 4*d* formed in one piece with the ink tank 1*a*, 1*b*, 1*c*, or 1*d* which has been consumed to the predetermined quantity is empty, the control unit 7 is not concerned with the quantity of waste ink stored in the reservoir tank 3, but controls the pump 5 to discharge the waste ink stored in the reservoir tank 3 into the corresponding waste ink tank 4*a*, 4*b*, 4*c*, or 4*d*.

As shown in the flowchart of FIG. 4, in Step S20, the control unit 7 discriminates whether or not the ink of either of the ink tanks 1*a*, 1*b*, 1*c*, and 1*d* has been consumed to the predetermined quantity of consumption (for example, 90% of the initial quantity of ink with which the ink tanks 1*a*, 1*b*, 1*c*, and 1*d* are filled). In addition, the discrimination as to whether ink of the predetermined quantity has been consumed in the ink tanks 1*a*, 1*b*, 1*c*, and 1*d* or not is discriminated based on the printing frequency of the printing head, the cleaning frequency of the printing head or the like.

As a result of the discrimination in Step S20, if ink of the predetermined quantity has not been consumed in the ink tanks 1*a*, 1*b*, 1*c*, and 1*d*, the control unit 7 determines that it is not necessary to discharge the waste ink and ends the series of processings.

On the other hand, as a result of the discrimination in Step S20, if ink of the predetermined quantity has been consumed in one of the ink tanks 1*a*, 1*b*, 1*c*, and 1*d*, the processing goes to Step S21.

In Step S21, the control unit 7 discriminates whether or not the corresponding waste ink tank 4*a*, 4*b*, 4*c*, or 4*d* is empty based on information written into the memory 8*a*, 8*b*, 8*c*, or 8*d* of the ink tank 1*a*, 1*b*, 1*c*, or 1*d* which has consumed ink of the predetermined quantity. As a result of the discrimination, if the corresponding waste ink tank 4*a*, 4*b*, 4*c*, or 4*d* is not empty, the control unit 7 ends the series of processings.

On the other hand, as a result of the discrimination in Step S21, if the corresponding waste ink tank 4*a*, 4*b*, 4*c*, or 4*d* is empty, the processing goes to Step S22.

In Step S22, the control unit 7 discriminates whether or not the quantity of waste ink stored in the reservoir tank 3 is more than or equal to the predetermined quantity S (100 $cm^3$) based on the detected signal from the waste ink sensor 10. As a result of the discrimination, if the quantity of waste ink stored in the reservoir tank 3 is less than the predetermined quantity S (100 $cm^3$), the processing goes to Step S23. In Step S23, the control unit 7 controls the pump 5 to discharge all of the waste ink stored in the reservoir tank 3 into the corresponding empty waste ink tank. According to processing of this step S23, it can be prevented that an ink tank, which exhausted the ink for printing, is discarded while the waste ink tank remains in an empty state.

On the other hand, as a result of the discrimination in Step S22, if the quantity of waste ink stored in the reservoir tank 3 is more than or equal to the predetermined quantity S (100 $cm^3$), in Step S24, the control unit 7 controls the pump 5 to discharge the waste ink of the predetermined quantity S (100 $cm^3$) into the corresponding empty waste ink tank referring to the driving frequency of the pump 5 and/or the detected signal from the waste ink sensor 10.

Next, in Step S25, the control unit 7 controls the information writing unit 9 to write information indicating that the waste ink tank is full to the memory 8*d* of the ink tank id corresponding to the waste ink tank to which the waste ink is discharged.

In the above explanation of the present embodiments, since waste ink is temporarily held in the reservoir tank 3 and waste ink of the predetermined quantity S is controlled to be discharged from the reservoir tank 3 into the empty waste ink tank 4*a*, 4*b*, 4*c*, or 4*d*, waste ink can be discharged without complicated controlling. Further, even if waste ink tanks are provided for each ink color respectively, the capacity of the waste ink tanks of each color are easily manageable. That is, since the control unit 7 need only manage the emptiness condition of the waste ink tank 4*a*, 4*b*, 4*c*, or 4*d* as the two kinds of status of "empty" or "not empty", and need only control the pump 5 to discharge waste ink of the predetermined quantity S (for example, 100 $cm^3$) stored in the reservoir tank 3 to the empty waste ink tank 4*a*, 4*b*, 4*c*, or 4*d*, waste ink can be discharged and collected without performing any complicated control.

Further, since information indicating whether or not the waste ink tank is empty is written into the memories 8*a*, 8*b*, 8*c* and 8*d* of each of the waste ink tanks 4*a*, 4*b*, 4*c* and 4*d*, discharging of the waste ink to the waste ink tanks 4*a*, 4*b*, 4*c* and 4*d*, which is not empty, and overflowing of the waste ink can be prevented.

Furthermore, since each of the waste ink tanks 4*a*, 4*b*, 4*c* and 4*d* are formed in one piece with the ink tanks 1*a*, 1*b*, 1*c* and 1*d* respectively, even if variations in the amount of the ink consumption occurs for every ink color, it can be prevented that the waste ink overflows from the waste ink tanks 4*a*, 4*b*, 4*c* and 4*d*. Further, since the waste ink can be distributed and discharged into the waste ink tank for every ink color, the capacity of the waste ink tanks 4*a*, 4*b*, 4*c* and 4*d* can also be configured small. Furthermore, when exchanging the ink tank of each color, the waste ink tank can also be discarded together.

Moreover, since the waste ink tanks 4*a*, 4*b*, 4*c*, and 4*d* are configured as a sealing structure such as a valve 41, a seal 42 or the like, it can be prevented that waste ink leaks from the waste ink tanks 4*a*, 4*b*, 4*c*, and 4*d*.

As is clear from above explanation, the ink-jet recording apparatus and the method for controlling the ink-jet recording apparatus, which can control of the discharge of waste ink easy and can collect the discharged waste ink easily, can be provided.

Although the embodiments of the present invention have been described in detail, the present invention may be embodied in other specific forms without departing from the spirit or essential characteristics thereof.

For example, in the above embodiments, although the example of the ink tanks 1*a*, 1*b*, 1*c*, and 1*d* which store ink of four colors of CMYK respectively was shown, it is not limited to this example. For example, six waste ink tanks maybe formed in one piece respectively with six ink tanks storing ink of six colors of Cyan (C), Magenta (M), Yellow (Y), blacK (K) Light cyan (Lc), and Light magenta (Lm), or formed in one piece respectively with six ink tanks storing ink of six colors of Cyan (C), Magenta (M), Yellow (Y), blacK (K), Orange (Or) and Green (G). Anyway, since the emptiness condition of the waste ink tanks is managed as two kinds of status of "empty" and "not empty", and the pump may be controlled simply to discharge the waste ink of the predetermined quantity S stored in the reservoir tank into the empty waste ink tank, and the waste ink can be discharged and collected without performing any complicated control.

Moreover, although the ink-jet printer 50 was explained as the example in the above embodiments, the technology of this enforcement may apply to other ink-jet recording apparatus, for example, a copier machine, facsimiles, or a multi function machine combining these functions of an ink jet system.

Thus, the present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

This application claims benefit of priority under 35 USC §119 to Japanese Patent Application No. 2002-298440 filed on Oct. 11, 2002, the entire contents of which are incorporated by reference herein.

What is claimed is:

1. An apparatus for ink-jet recording, the apparatus for printing by emitting of a jet of ink onto a printing paper comprising:

ink tanks installed removably in the apparatus, and configured to store ink;

a reservoir tank configured to temporarily store waste ink generated by a printing head, said printing head configured for jetting ink supplied from the ink tanks onto the printing paper;

waste ink tanks formed in one piece with the ink tanks, and configured to store waste ink discharged from the reservoir tank;

a discharging unit configured to discharge waste ink from the reservoir tank into the waste ink tanks;

a control unit configured to discriminate whether or not the waste ink tanks are empty, and to control the discharging unit to discharge waste ink of a predetermined quantity stored in the reservoir tank into the empty waste ink tank; and a waste ink sensor configured to detect the quantity of waste ink stored in the reservoir tank, wherein when the control unit detects that the quantity of waste ink stored in the reservoir tank exceeds a predetermined quantity based on a detection result of the waste ink sensor, the control unit controls the discharging unit to discharge waste ink of the predetermined quantity stored in the reservoir tank into the empty waste ink tank.

2. The apparatus of claim 1, wherein:

the ink tanks are installed independently for each color of the ink; and the waste ink tanks are paired off and formed in one piece with each of the ink tanks respectively.

3. The apparatus of claim 1, further comprising memories configured to store information indicating whether or not each of the waste ink tanks is empty respectively, wherein the control unit discriminates whether or not each of the waste ink tanks is empty based on information stored in the memories, and writes information indicating that the waste ink tank is full to the memory of the waste ink tank to which the waste ink is discharged.

4. The apparatus of claim 1, wherein when the plural empty waste ink tanks are installed, the control unit controls the discharging unit to discharge the waste ink into the waste ink tank formed in one piece with the ink tank with a highest supply frequency of the ink.

5. The apparatus of claim 1, wherein: the discharging unit is composed of a pump; and the control unit controls the quantity of the waste ink to be discharged based on a driving duration of the pump.

6. The apparatus of claim 1, wherein the waste ink tank includes a pouring mouth configured as a sealing structure.

7. The apparatus of claim 1, wherein when a tank only for waste ink, of the whole which is formed to store waste ink, is installed instead of the ink tank, the control unit controls the discharging unit to discharge the waste ink by force into the tank only for the waste ink.

8. The apparatus of claim 1, wherein the control unit controls the discharging unit to discharge waste ink of the predetermined quantity stored in the reservoir tank into the waste ink tank in multiple steps.

9. The apparatus of claim 1, wherein the control unit controls the discharging unit to discharge the waste ink of the predetermined quantity stored in the reservoir tank into the waste ink tank in a single step.

10. An apparatus for ink-jet recording, the apparatus for printing by emitting of a jet of ink onto a printing paper comprising:

ink tanks installed removably in the apparatus, and configured to store ink;

a reservoir tank configured to temporarily store waste ink generated by a printing head said printing head configured for jetting ink supplied from the ink tanks onto the printing paper;

waste ink tanks formed in one piece with the ink tanks, and configured to store waste ink discharged from the reservoir tank;

a discharging unit configured to discharge waste ink from the reservoir tank into the waste ink tanks;

a control unit configured to discriminate whether or not the waste ink tanks are empty, and to control the discharging unit to discharge waste ink of a predetermined quantity stored in the reservoir tank into the empty waste ink tank; and a waste ink sensor configured to detect the quantity of waste ink stored in the reservoir tank, wherein:

the control unit discriminates whether or not the waste ink tank formed in one piece with the ink tank which has consumed ink of the predetermined quantity is empty;

the control unit controls the discharging unit to discharge waste ink of the predetermined quantity stored in the reservoir tank into the waste ink tank discriminated as being empty, when the quantity of waste ink detected by the waste ink sensor is more than or equal to the predetermined quantity; and the control unit controls the discharging unit to discharge all of the waste ink stored in the reservoir tank into the corresponding empty waste ink tank, when the quantity of waste ink detected by the waste ink sensor is less than the predetermined quantity.

11. The apparatus of claim 10, wherein:

the ink tanks are installed independently for each color of the ink; and the waste ink tanks are paired off and formed in one piece with each of the ink tanks respectively.

12. The apparatus of claim 10, further comprising memories configured to store information indicating whether or not each of the waste ink tanks is empty respectively, wherein the control unit discriminates whether or not each of the waste ink tanks is empty based on information stored in the memories, and writes information indicating that the waste ink tank is full to the memory of the waste ink tank to which the waste ink is discharged.

13. The apparatus of claim 10, wherein when the plural empty waste ink tanks are installed, the control unit controls the discharging unit to discharge the waste ink into the waste ink tank formed in one piece with the ink tank with a highest supply frequency of the ink.

14. The apparatus of claim 10, wherein: the discharging unit is composed of a pump; and the control unit controls the quantity of the waste ink to be discharged based on a driving duration of the pump.

15. The apparatus of claim 10, wherein the waste ink tank includes a pouring mouth configured as a sealing structure.

16. The apparatus of claim 10, wherein when a tank only for waste ink, of the whole which is formed to store waste ink, is installed instead of the ink tank, the control unit controls the discharging unit to discharge the waste ink by force into the tank only for the waste ink.

17. The apparatus of claim 10, wherein the control unit controls the discharging unit to discharge waste ink of the predetermined quantity stored in the reservoir tank into the waste ink tank in multiple steps.

18. The apparatus of claim 10, wherein the control unit controls the discharging unit to discharge the waste ink of the predetermined quantity stored in the reservoir tank into the waste ink tank in a single step.

19. A method of controlling an apparatus for ink-jet recording, the apparatus including ink tanks removably installed in the apparatus and storing an ink for each color of the ink, a reservoir tank temporarily storing a waste ink generated by a printing head, said printing head configured for jetting the ink supplied from the ink tanks onto a printing paper, waste ink tanks formed in one piece with the ink tanks and storing waste ink discharged from the reservoir tank, a waste ink sensor configured to detect the quantity of waste ink stored in the reservoir tank, and a discharging unit discharging waste ink from the reservoir tank into the waste ink tanks, the method comprising:

storing waste ink generated by the printing head in the reservoir tank;

discriminating whether or not the waste ink tank is empty based on information stored in said memory indicating whether or not the waste ink tank is empty;

controlling the discharging unit to discharge waste ink of a predetermined quantity stored in the reservoir tank into the empty waste ink tank discriminated, and when the waste ink sensor detects that the quantity of waste ink stored in the reservoir tank exceeds the predetermined quantity and at least one of the waste ink tank is discriminated as being empty, the discharging unit is controlled to discharge the waste ink of the predetermined quantity stored in the reservoir tank into the waste ink tank discriminated as empty.

20. The method of claim 19, wherein when a fresh ink tank is installed in the apparatus and the waste ink tank formed in one piece with the fresh ink tank is discriminated as being empty, the discharging unit is controlled to discharge the waste ink of the predetermined quantity stored in the reservoir tank into the waste ink tank discriminated as empty.

21. A method of controlling an apparatus for ink-jet recording, the apparatus including ink tanks removably installed in the apparatus and storing an ink for each color of the ink, a reservoir tank temporarily storing a waste ink generated by a printing head, said printing head configured for jetting the ink supplied from the ink tanks onto a printing paper, waste ink tanks formed in one piece with the ink tanks and storing waste ink discharged from the reservoir tank, a waste ink sensor configured to detect the quantity of waste ink stored in the reservoir tank, and a discharging unit discharging waste ink from the reservoir tank into the waste ink tanks, the method comprising:

storing waste ink generated by the printing head in the reservoir tank;

discriminating whether or not the waste ink tank is empty based on information stored in said memory indicating whether or not the waste ink tank is empty;

controlling the discharging unit to discharge waste ink of a predetermined quantity stored in the reservoir tank into the empty waste ink tank discriminated; and when at least one of the waste ink tank formed in one piece with the ink tank which has consumed ink of the predetermined quantity is discriminated as being empty, the discharging unit is controlled to discharge waste ink of the predetermined quantity stored in the reservoir tank into the waste ink tank discriminated as being empty, if the quantity of the waste ink detected by the waste ink sensor is more than or equal to the predetermined quantity, and the discharging unit is controlled to discharge all of the waste ink stored in the reservoir tank into the corresponding empty waste ink tank, if the quantity of waste ink detected by the waste ink sensor is less than the predetermined quantity.

22. The method of claim 21, wherein when a fresh ink tank is installed in the apparatus and the waste ink tank formed in one piece with the fresh ink tank is discriminated as being empty, the discharging unit is controlled to discharge the waste ink of the predetermined quantity stored in the reservoir tank into the waste ink tank discriminated as empty.

* * * * *